US010124343B2

(12) United States Patent
Tsai

(10) Patent No.: US 10,124,343 B2
(45) Date of Patent: Nov. 13, 2018

(54) CRUSHER WITH CUTTER ASSEMBLY AND CUTTER THEREOF

(71) Applicant: KUN SHENG MACHINE CO., LTD., Taichung (TW)

(72) Inventor: Chao-Fa Tsai, Taichung (TW)

(73) Assignee: Kun Sheng Machine Co., Ltd., Taichung (TW)

( * ) Notice: Subject to any disclaimer, the term of this patent is extended or adjusted under 35 U.S.C. 154(b) by 565 days.

(21) Appl. No.: 14/828,246

(22) Filed: Aug. 17, 2015

(65) Prior Publication Data

US 2016/0089675 A1 Mar. 31, 2016

(30) Foreign Application Priority Data

Sep. 26, 2014 (TW) ..... 103133568 A

(51) Int. Cl.

*B02C 4/20* (2006.01)
*B02C 4/28* (2006.01)
*B02C 18/18* (2006.01)

(52) U.S. Cl.

CPC ..... *B02C 4/20* (2013.01); *B02C 4/286* (2013.01); *B02C 18/18* (2013.01); *B02C 2018/188* (2013.01)

(58) Field of Classification Search

CPC ..... B02C 4/20; B02C 4/286; B02C 18/18
See application file for complete search history.

(56) References Cited

U.S. PATENT DOCUMENTS

| | | | | |
|---|---|---|---|---|
| 7,959,099 | B1 * | 6/2011 | Cox | B02C 18/18 241/294 |
| 9,527,088 | B2 * | 12/2016 | Haalisto | B02C 18/18 |
| 2004/0118958 | A1 * | 6/2004 | Sturm | B02C 18/145 241/243 |
| 2011/0100383 | A1 * | 5/2011 | Tilley | B02C 18/145 131/280 |
| 2012/0032013 | A1 * | 2/2012 | Rice | B02C 18/145 241/282.2 |
| 2015/0129694 | A1 * | 5/2015 | Honkanen | B27L 11/005 241/92 |

FOREIGN PATENT DOCUMENTS

| | | | |
|---|---|---|---|
| CN | 101623666 | B | 7/2013 |
| TW | 547139 | U | 8/2003 |
| TW | M449032 | U1 | 3/2013 |
| TW | M452602 | U | 5/2013 |

* cited by examiner

*Primary Examiner* — Omar Flores Sanchez
(74) *Attorney, Agent, or Firm* — Muncy, Geissler, Olds & Lowe, P.C.

(57) ABSTRACT

A crusher includes a base, a cylinder pivoted to the base, cutting portions arranged on the cylinder. A crusher cutter assembly is further provided, including: a cutter base, for being assembled to the crusher, having receiving slots including an abutting recess and a bottom portion. A crusher cutter is further provided for assembling on the cutter base. The crusher cutter includes: two corner portions, disposed on two sides thereof, for being inserted in the abutting recess and fixed on the cutter base, two sides of the corner portion abutting against the abutting recess; two abutting portions, disposed on two opposite sides of the crusher cutter, for being positionably abutting against another crusher cutter; wherein when the crusher cutter is fixed on the cutter base, a part of the corner portion protrudes beyond the cutter base and is alternatively shifted with a part of the cutting portions.

9 Claims, 6 Drawing Sheets

CRUSHER WITH CUTTER ASSEMBLY AND CUTTER THEREOF

BACKGROUND OF THE INVENTION

Field of the Invention

The present invention relates to a crusher, and more particularly to a crusher with a cutter assembly and cutters thereof.

Description of the Prior Art

Usually, in a conventional crusher as disclosed in TWM449032, cutters are arranged on a cutter base, and an interval between each two cutters next to each other is adjusted through screwing. However, when the cutters are adjusted and screwed repeatedly, a screw or a threaded hole is prone to having stripped threads.

The present invention has arisen to mitigate and/or obviate the afore-described disadvantages.

SUMMARY OF THE INVENTION

The major object of the present invention is to provide a crusher with a cutter assembly and cutters thereof for being detachably disposed on the cutter base, and an arrangement of a single crusher cutter may be changed so that the crusher cutter may be replaced when being damaged. A corner portion and an abutting recess positionably abut against each other to precisely position each other, and a force between the corner portion and the abutting recess can be counterbalanced through the corner portion and the abutting recess abutting against each other. A conical wall of a hourglass-shaped through hole and a conical head of a first screw member tightly abut against each other so that the crusher cutter is stably assembled on the cutter base to prevent the crusher cutter from shaking and increase working efficiency. In addition, the crusher cutter assembly may have a cover body to further fix the crusher cutter so as to prevent shaking and elevate working efficiency, and the crusher cutter assembly may be used in cooperation with a pushing board to increase the efficiency of crushing materials.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
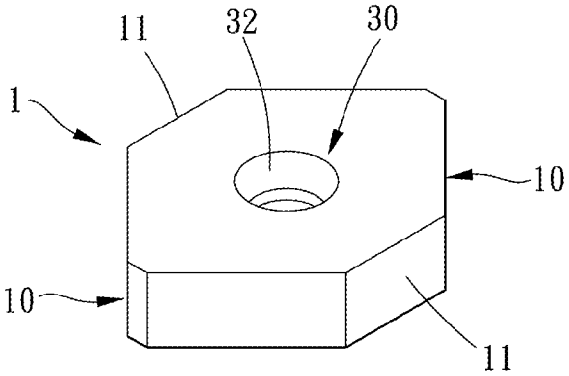
FIG. 1 is a drawing showing a first embodiment of the present invention.
Figure 2:
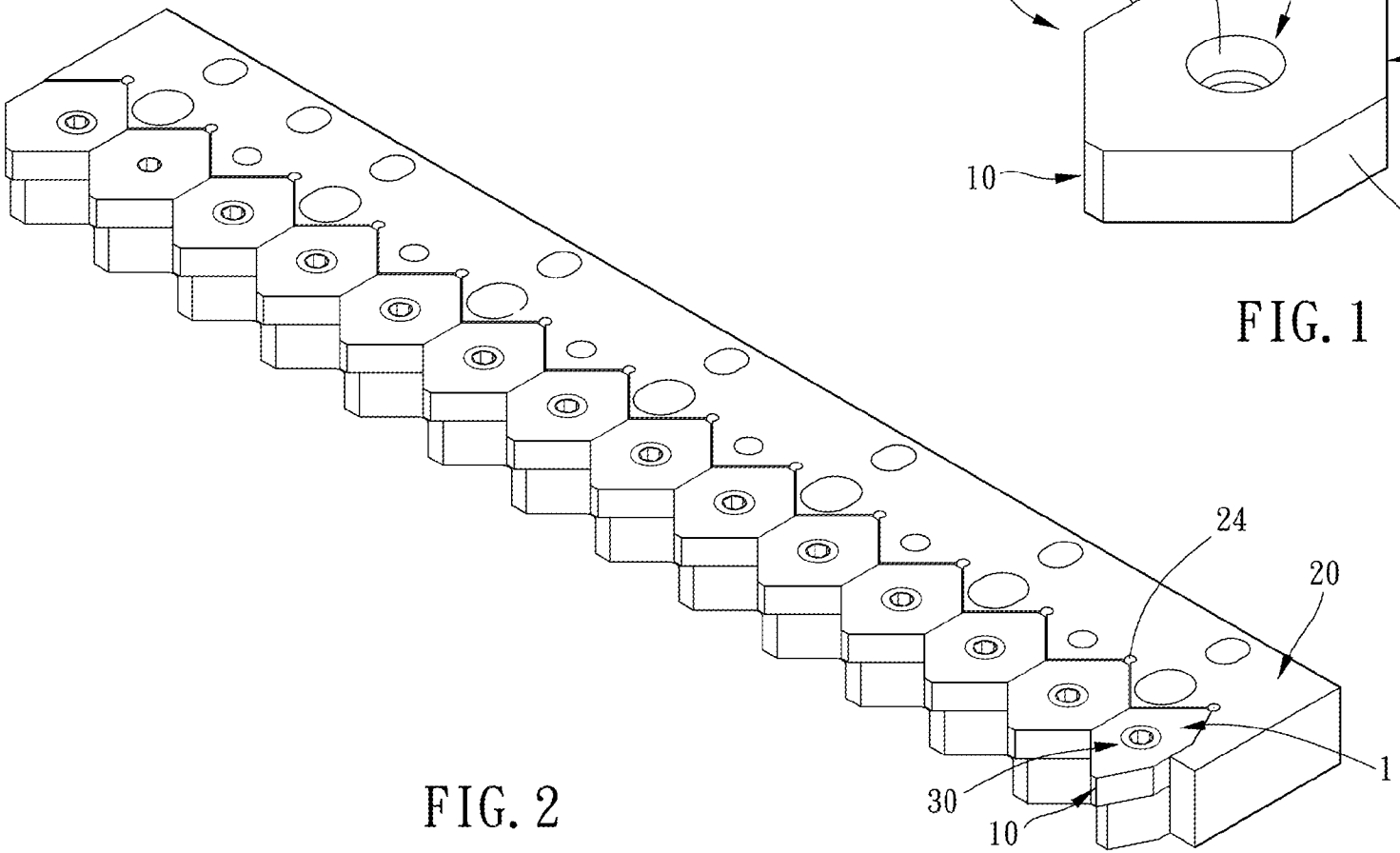
FIG. 2 is an assembling drawing of the first embodiment of the present invention.
Figure 3:
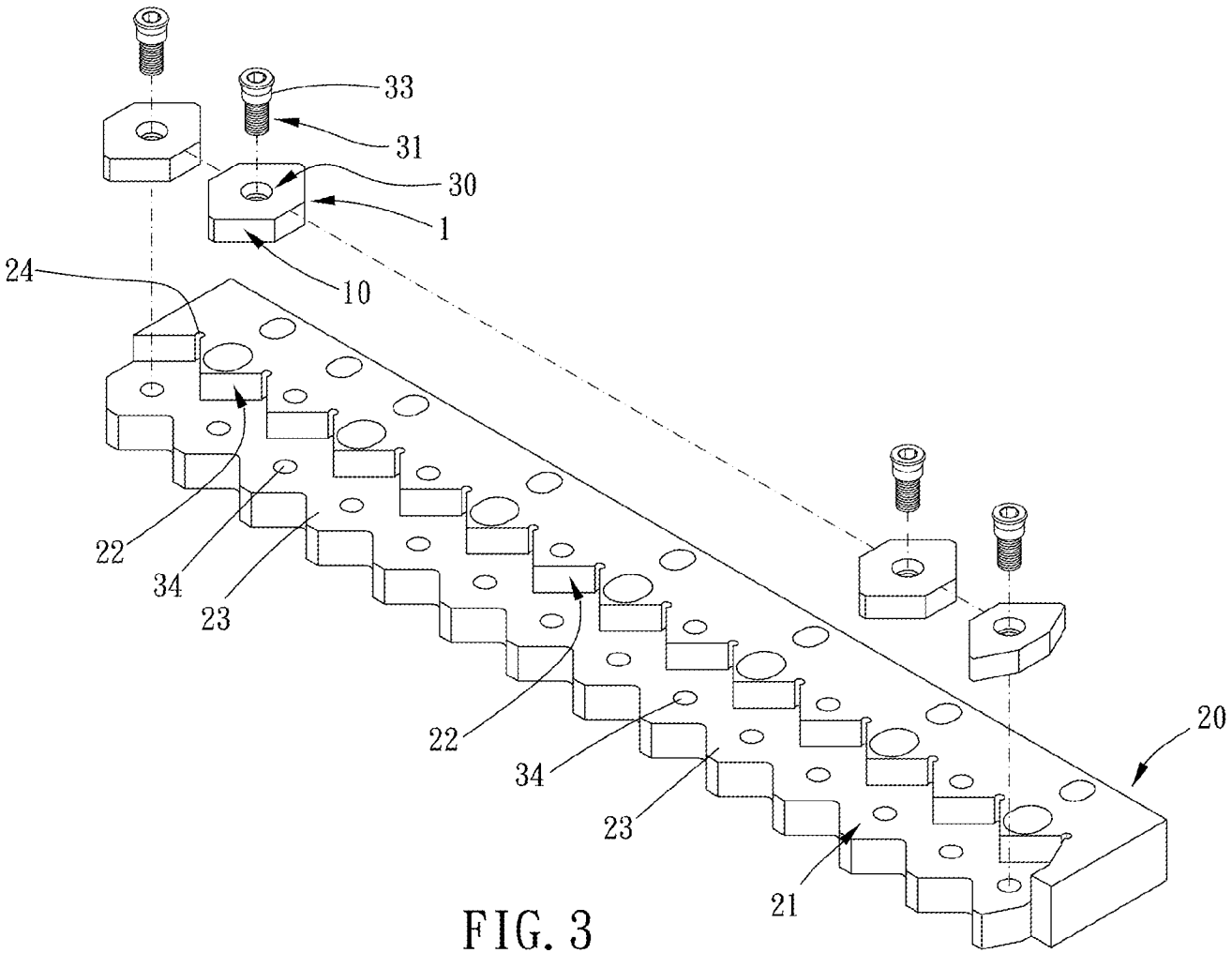
FIG. 3 is a breakdown drawing of the first embodiment of the present invention.

Please refer to FIGS. 1 to 3 for a first embodiment of the present invention. The crusher cutter 1 is provided for being assembled on a cutter base 20 of a crusher. The cutter base 20 has a plurality of receiving slots 21, and each said receiving slot 21 includes an abutting recess 22 steppedly recessed on a surface of the cutter base 20 and a bottom portion 23 with a difference with respect to the surface of the cutter base 20. The crusher cutter 1 includes two corner portions 10 and two abutting portions 11.

The two corner portions 10 are disposed on two opposite sides of the crusher cutter 1 along a first direction respectively. The corner portion 10 is for being inserted into the abutting recess 22 and detachably fixed on the cutter base 20. At least two sides of the corner portion 10 abut against the abutting recess 22. When the crusher cutter 1 is assembled on the cutter base 20, the corner portion 10 and the abutting recess 22 can abut against each other to position each other.

In this embodiment, a force between the corner portion 10 and the abutting recess 22 can be counterbalanced through abutting of the corner portion 10 and the abutting recess 22 which are V shaped. The corner portion 10 and the abutting recess 22 may be in other shapes which allow the corner portion 10 and the abutting recess 22 to abut against and position each other. The two corner portions 10 allow the crusher cutter 1 to be interchangeably assembled to the abutting recess 22 along the first direction; therefore, when the crusher cutter 1 is fixed on the cutter base 20, at least a part of the corner portion 10 protrudes beyond the cutter base 20 to conduct cutting or crushing operations.

The two abutting portions 11 are disposed on two opposite sides of the crusher cutter 1 along a second direction, and the second direction is substantially perpendicular to the first direction. Each said abutting portion 11 is provided for positionably abutting against an abutting portion 11 of another crusher cutter 1. When a plurality of the crusher cutters 1 are assembled on the cutter base 20, the crusher cutters 1 positionably abut against each other through the abutting portion 11 to allow the crusher cutter 1 to be stably assembled on the cutter base 20. Preferably, an arrangement of the crusher cutter 1 is interchangeable along the second direction.

The crusher cutter 1 is formed with a hourglass-shaped through hole 30 along a third direction, and the third direction is perpendicular to the first and second directions. The hourglass-shaped through hole 30 is for a first screw member 31 to dispose therethrough to fix the crusher cutter 1 on the cutter base 20, and an inner wall of the hourglass-shaped through hole 30 includes two conical walls 32 at two ends thereof and tapered toward each other. The conical wall 32 is for a conical head 33 of the first screw member 31 whose shape corresponds a shape of the conical wall 32 to tightly abut thereagainst. The bottom portion 23 of the cutter base 20 has a threaded hole 34 whose position corresponds to a position of the hourglass-shaped through hole 30 so that the crusher cutter 1 is fixed on the bottom portion 23 through the first screw member 31 being screwed to the threaded hole 34. An included angle is defined between the conical wall 32 and an axial direction of the hourglass-shaped through hole 30, and the included angle may be preferably 2 to 3 degrees.

Preferably, when the crusher cutter 1 is assembled and positioned through the first screw member 31 and the hourglass-shaped through hole 30 being screwed to each other, the crusher cutter 1 can abut against another said crusher cutter 1 to interchangeably fix the crusher cutter 1 on the bottom portion 23 along the third direction. The crusher cutter 1 may change the arrangement along the first, second or third directions. The crusher cutter may rotate 180 degrees along the third direction to make the crusher cutter back to front, or the crusher cutter may rotate 180 degrees along the first direction to make the crusher cutter upside down. Therefore, when an end of the crusher cutter is abraded, the user may change the arrangement of the crusher cutter to continue an operation with a non-used end of the crusher cutter.

Each said abutting recess 22 defines an abutting space. The cutter base 20 further includes a curved slot 24 which is disposed at an end of the abutting recess 22 and communicated with the abutting space, and the curved slot 24 is for receiving a part of an end of the corner portion 10. The part of the end of the corner portion 10 may deform due to processing error or heat, so the curved slot 24 provides a reserved space for assembling.

Figure 5:
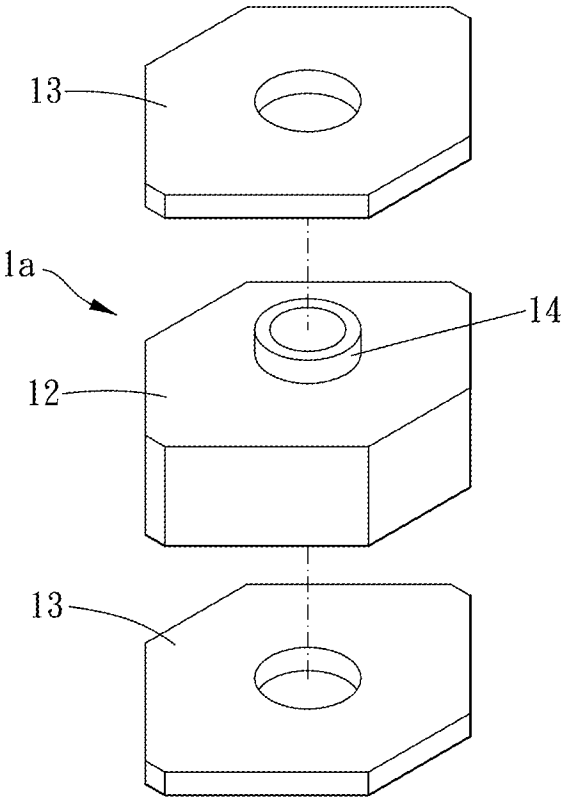
FIG. 5 is a breakdown drawing of the second embodiment of the present invention.
Figure 4:
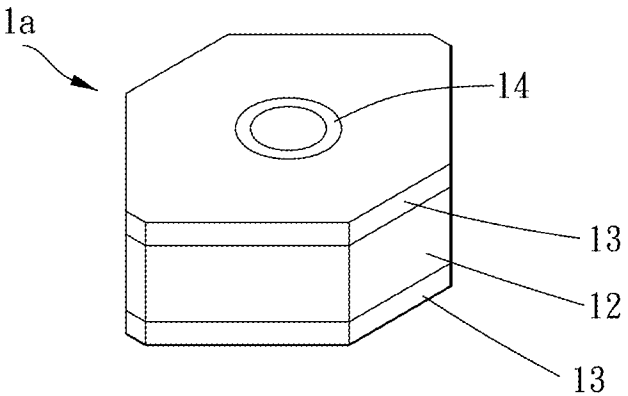
FIG. 4 is a drawing showing a second embodiment of the present invention.
Figure 6:
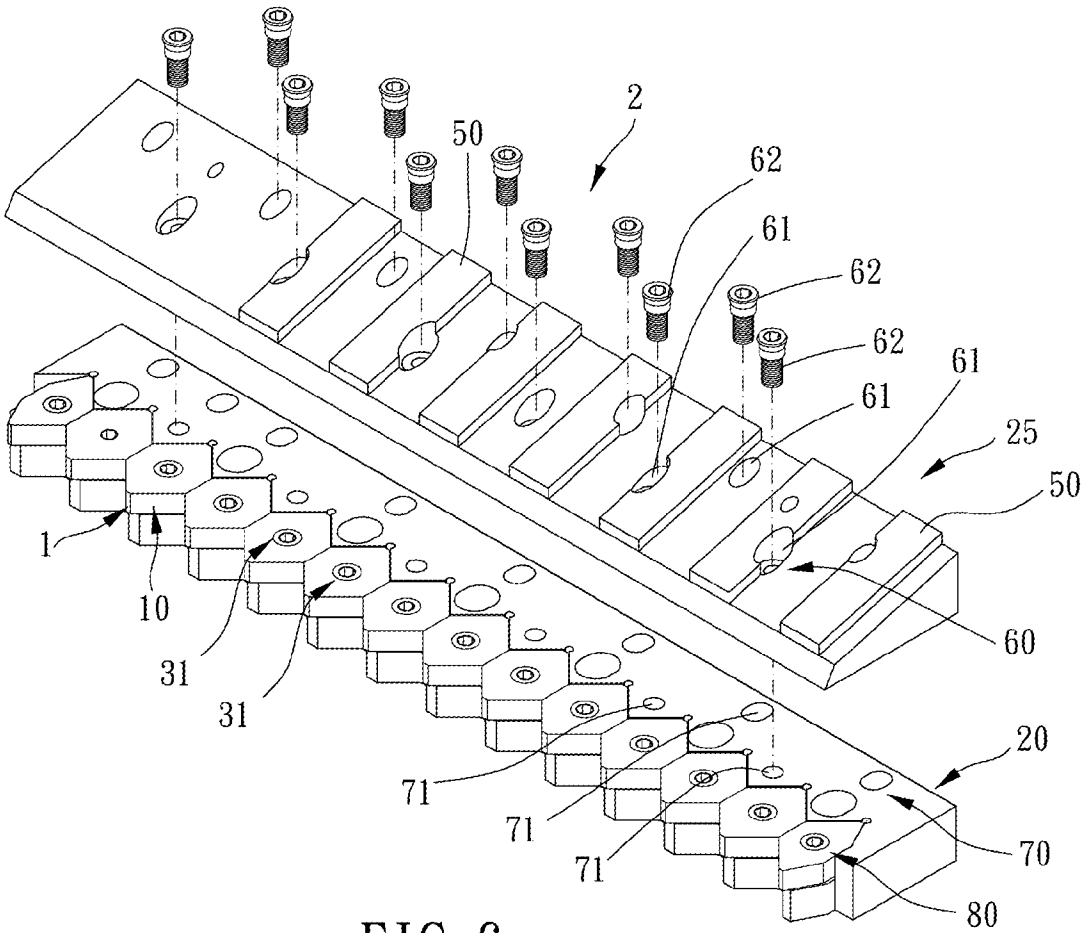
FIG. 6 is a breakdown drawing of a third embodiment of the present invention.
Figure 8:
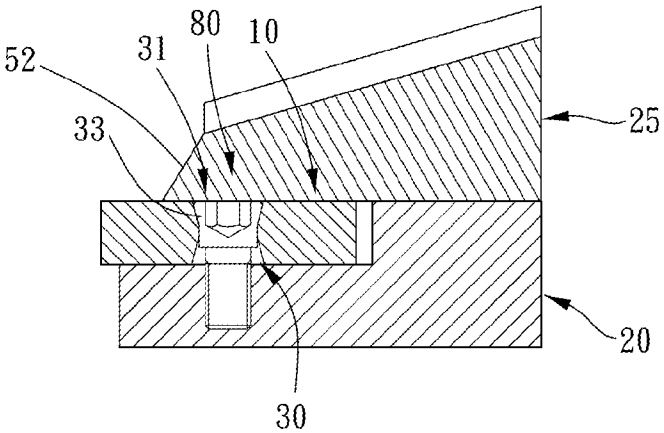
FIG. 8 is a cross-sectional drawing of the third embodiment of the present invention.
Figure 7:
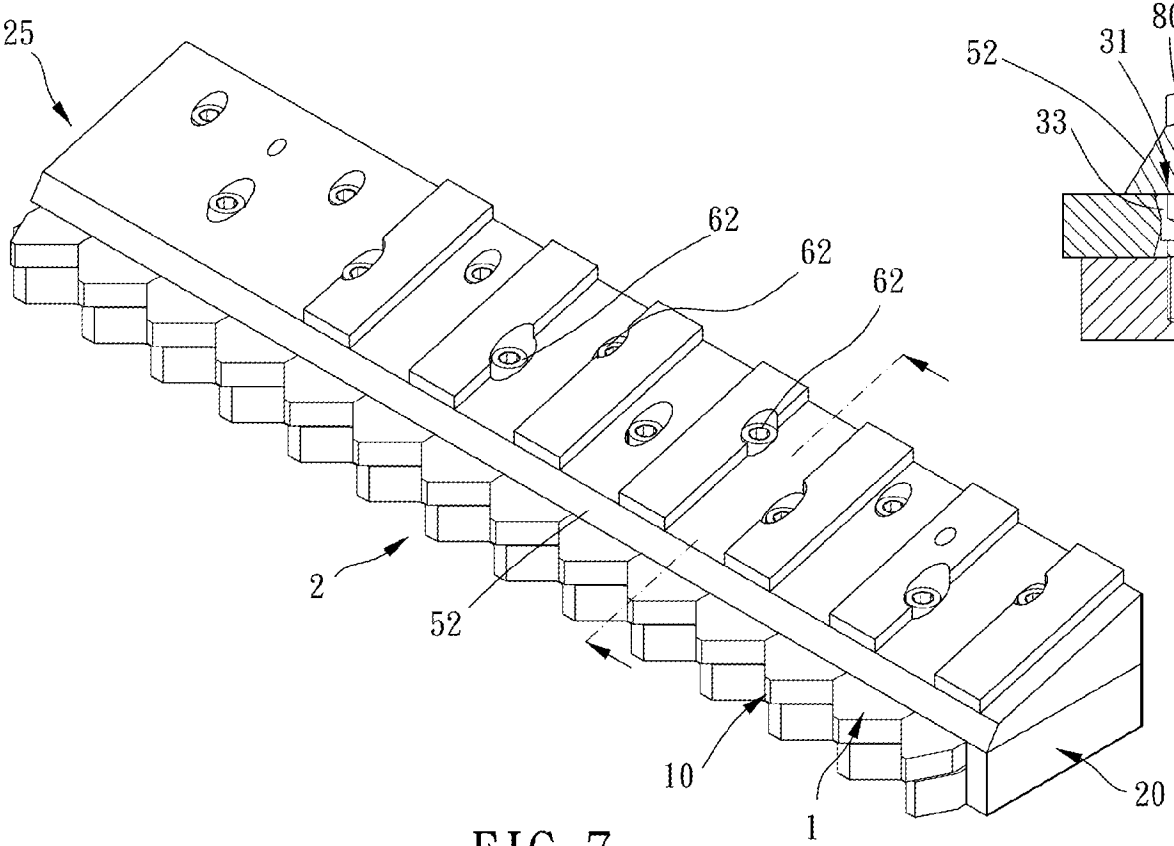
FIG. 7 is a drawing showing the third embodiment of the present invention.

Please refer to FIGS. 4 and 5 for a second embodiment of the present invention. A crusher cutter 1*a* may include a middle layer 12 and two outer layers 13 on two opposite sides of the middle layer 12 respectively. The crusher cutter may be integrally formed with a material. One of the two outer layers 13 is fittingly engaged with the bottom portion of the receiving slot parallelly when the crusher cutter 1*a* is fixed on the cutter base. The two outer layers 13 are greater than the middle layer 12 in rigidity, and the two outer layers 13 are preferably made of tungsten steel or tungsten alloy. The middle layer 12 may include two positioning protrusions 14 disposed on two opposite sides of the middle layer 12 respectively, and the two outer layers 13 are disposed around the two positioning protrusion 14 on two opposite sides of the middle layer 12. Through the positioning protrusion 14, it is convenient for the user to positionably assemble the two outer layers 13 to the middle layer 12. The two outer layers 13 may be fixed to the middle layer 12 through, for example, brazing.

Please refer to FIGS. 6 to 9 for a third embodiment of the present invention in which components the same as those of the first embodiment are designated with the same reference numerals. A crusher cutter assembly 2 is further provided, including at least one crusher cutter 1 and a cutter base 20 mentioned above. The cutter base 20 is for being assembled to a crusher 3, when the crusher cutter 1 is fixed on the cutter base 20, at least a part of the corner portion 20 protrudes beyond the cutter base 20. The crusher cutter assembly 2 further includes a cover body 25, and the cover body 25 is detachably fixed on the cutter base 20. Each said crusher cutter 1 is sandwiched between the cover body 25 and the cutter base 20, and the cover body 25 can further fix the crusher cutter 1 to prevent the crusher cutter 1 from shaking. The two corner portions 10 of the crusher cutter 1 define a center portion 80 therebetween, and the cover body 25 covers an entirety of one of the two corner portions 10 and at least a part of the center portion 80 so that the cover body 25 presses the crusher cutter 1 to prevent the crusher cutter 1 from shaking.

Figure 9:
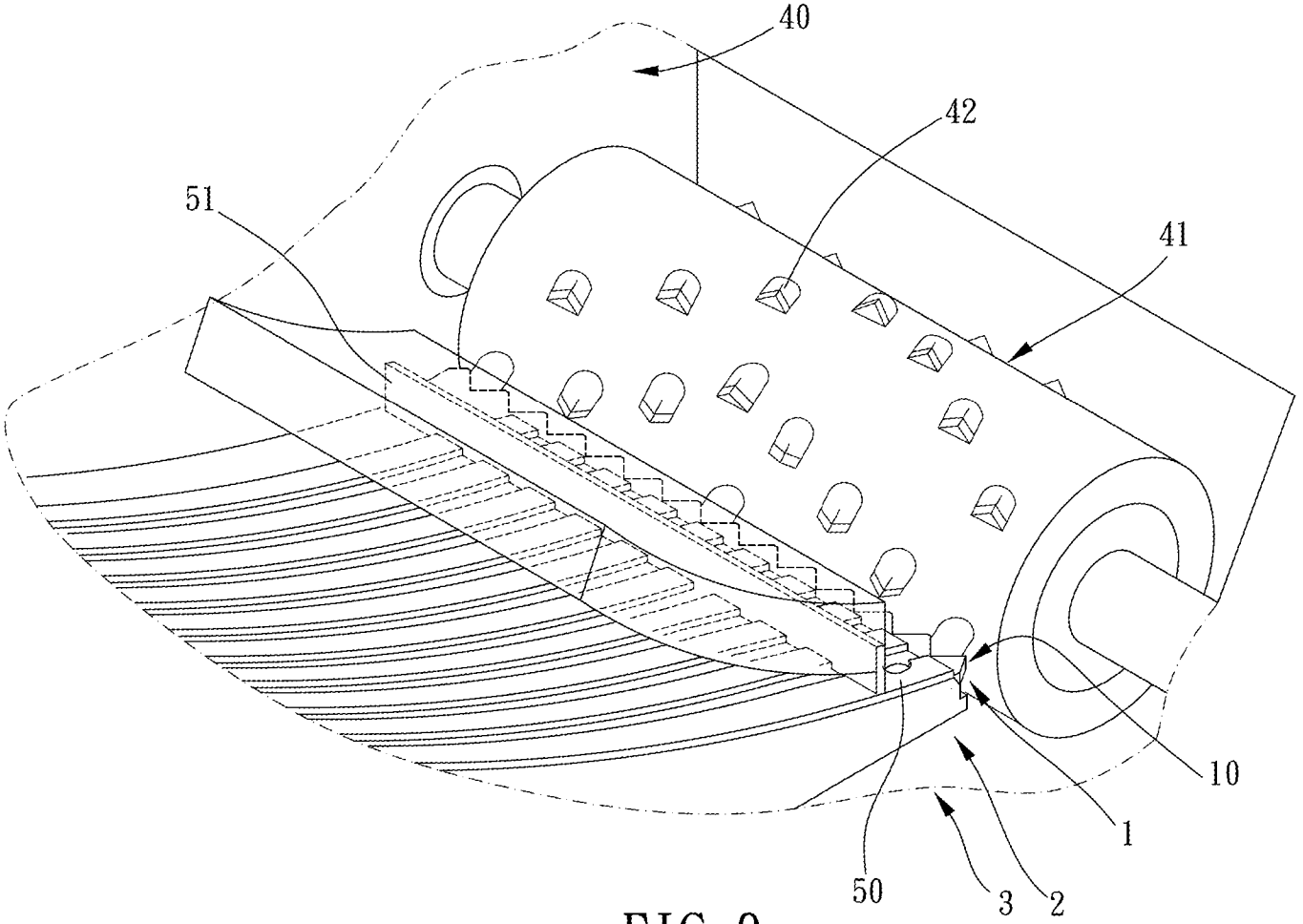
FIG. 9 is a drawing showing the third embodiment of the present invention in use.

More specifically, a side of the cover body 25 may be further formed with a plurality of protrusions 50 arranged in intervals, and each of the protrusions 50 extends toward the corner portion 10. The protrusions 50 may be for guiding a pushing board 51 to move forward (as shown in FIG. 9). For example, the pushing board 51 may have a guiding structure, and a shape of the guiding structure corresponds to a shape of the protrusions 50 so that the pushing board 51 can slide and move forward along the protrusions 50. The pushing board 51 is for pushing a material to the corner portion 10 to be crushed. Preferably, the protrusions 50 may also guide or disperse the material to increase the efficiency of crushing the material. A side of the cover body 25 facing the corner portion 10 may have a slanted face 52, and the slanted face 52 may further guide the material to move toward the corner portion 10.

The cover body 25 may have a first positioning portion 60, and the cutter base 20 may have a second positioning portion 70 corresponding to the first positioning portion 60. The first and second positioning portions are positioned and fixed with each other. For example, the first positioning portion 60 may include a plurality of through holes 61 arranged in intervals thereon along a length direction of the cover body 25, and the through holes 61 are alternatively shifted widthwise on the cover body 25. At least a part of the through holes 60 is disposed through at least a part of the protrusions 50. The second positioning portion 70 may include a plurality of threaded holes 71 corresponding to the through holes 61, and each said through hole 61 is disposed through by a second screw member 62. Each said second screw member 62 is fixedly screwed to each said threaded hole 71 to positionably fix the cover body 25 on the cutter base 20. It is to be noted that the through holes 61 and the threaded holes 71 which are alternatively arranged allow the cover body 25 to be stably fixed on the cutter base 20, and the at least a part of the through holes 61 disposed through the protrusion 50 has preferable structural strength to make the second screw member 62 stably disposed through the through hole 61 and to increase an assembling stability of the cover body 25 and the cutter base 20.

Furthermore, the conical head 33 of each said first screw member 31 is embedded into the hourglass-shaped through hole 30 more than ½ of a depth of the hourglass-shaped through hole 30 so that the first screw member 31 and the hourglass-shaped through hole 30 are tightly restrained by each other.

Please further refer to FIG. 9 for a crusher 3 including the above-mentioned crusher cutter assembly 2 and further including a base 40, a cylinder 41 and a pushing board 51. The cylinder 41 is pivoted to the base 40, and a plurality of cutting portions 42 are annularly arranged on a circumferential face of the cylinder 41 in intervals. The corner portions 10 of the crusher cutters 1 are disposed near the circumferential face of the cylinder 41 and alternatively shifted with respect to a part of the cutting portions 42 relative to a circumferential direction of the cylinder 41. In actual practice, the pushing board 51 is movably disposed on the base 40, and the pushing board 51 has a guiding structure. A shape of the guiding structure corresponds to a shape of the protrusions of the cover body so that the pushing board 51 can move toward the cylinder 41 along the protrusions 50 and push the material toward the cylinder 41 and the corner portion 10 to be crusherd.

Given the above, the arrangement of the crusher cutter can be changed, so the service life of the same crusher cutter is prolonged due to changing arrangement. In addition, the corner portion and the abutting recess abut against each other to position each other.

While we have shown and described various embodiments in accordance with the present invention, it should be clear to those skilled in the art that further embodiments may be made without departing from the scope of the present invention.

What is claimed is:

1. A crusher cutter, provided for being assembled on a cutter base of a crusher, the cutter base having a plurality of receiving slots, each said receiving slot including an abutting recess steppedly recessed on a surface of the cutter base and a bottom portion, the crusher cutter including: two corner portions, disposed on two opposite sides of the crusher cutter along a first direction respectively, the corner portion for being inserted into the abutting recess and detachably fixed on the cutter base, at least two sides of the corner portion abutting against the abutting recess; two abutting portions, disposed on two opposite sides of the crusher cutter along a second direction, the first and second directions being substantially perpendicular to each other, each said abutting portion being for positionably abutting against one said abutting portion of another crusher cutter, when the crusher cutter is fixed on the cutter base, the corner portion at least partially protrudes beyond the cutter base, wherein the crusher cutter is formed with a hourglass-shaped through hole along a third direction, the third direction is perpendicular to the first and second directions, the hourglass-shaped through hole is for a first screw member to be disposed therethrough to fix the crusher cutter on the cutter base, an inner wall of the hourglass-shaped through hole includes two conical walls located at two ends thereof and tapered toward each other, the conical wall is for a conical head of the first screw member whose shape corresponds to the conical wall to tightly abut thereagainst, wherein the conical head is embedded into the hourglass-shaped through hole more than ½ of a depth of the hourglass-shaped through hole, and the conical head annularly abuts against a middle part of the conical wall of the hourglass-shaped through hole radially.

2. The crusher cutter of claim 1, wherein the crusher cutter includes a middle layer and two outer layers disposed on two opposite sides of the middle layer, one of the two outer layers is fittingly engaged with the bottom portion of the receiving slot parallelly when the crusher cutter is fixed on the cutter base, and the two outer layers are greater than the middle layer in rigidity.

3. A crusher cutter assembly, including at least one crusher cutter of claim 1, further including:

receiving slot including an abutting recess steppedly recessed on a surface of the cutter base and a bottom portion, the abutting recesss of either two receiving slots which are neighboring to each other being arranged in intervals and being communicated with each other;

wherein, the corner portion is inserted into the abutting recess and detachably fixed on the cutter base, and at least a part of the corner portion protrudes beyond the cutter base.

4. The crusher cutter assembly of claim 3, further including a cover body, the cover body detachably fixed on the cutter base, each said crusher cutter sandwiched between the cover body and the cutter base.

5. The crusher cutter assembly of claim 4, wherein a side of the cover body is formed with a plurality of protrusions arranged in intervals, and each of the protrusions extends toward the corner portion.

6. The crusher cutter assembly of claim 5, wherein the cover body has a first positioning portion, the cutter base has a second positioning portion corresponding to the first positioning portion, and the first and second positioning portions are positioned and fixed with each other.

7. The crusher cutter assembly of claim 6, wherein the first positioning portion includes a plurality of through holes arranged in intervals along a length direction of the cover body, the through holes are alternatively shifted widthwise on the cover body, at least a part of the through holes is disposed through at least a part of the protrusions, the second positioning portion includes a plurality of threaded holes corresponding to the through holes, each said through hole is disposed through by a second screw member, and each said second screw member is fixedly screwed to each said threaded hole.

8. The crusher cutter assembly of claim 4, wherein the two corner portions of the crusher cutter define a center portion therebetween, and the cover body covers an entirety of one of the corner portions and at least a part of the center portion.

9. A crusher, including the crusher cutter assembly of claim 5, further including:

a base;

a cylinder, pivoted to the base, a circumferential face of the cylinder formed with a plurality of cutting portions annularly arranged thereon in intervals, the corner portions of the crusher cutters being disposed near the circumferential face of the cylinder and alternatively shifted with respect to a part of the cutting portions relative to a circumferential direction of the cylinder;

a pushing board, movably disposed on the base, the pushing board having a guiding structure, a shape of the guiding structure corresponding to a shape of the protrusions of the cover body.

* * * * *